US010006671B2

(12) United States Patent
Xie et al.

(10) Patent No.: US 10,006,671 B2
(45) Date of Patent: Jun. 26, 2018

(54) AIR CONDITIONING SYSTEM AND METHOD FOR CONTROLLING SAME

(71) Applicant: GD MIDEA AIR-CONDITIONING EQUIPMENT CO., LTD., Foshan, Guangdong (CN)

(72) Inventors: Ligao Xie, Guangdong (CN); Jinbo Li, Guangdong (CN); Zhu Lin, Guangdong (CN); Yong Wang, Guangdong (CN)

(73) Assignee: GD MIDEA AIR-CONDITIONING EQUIPMENT CO., LTD., Foshan, Guangdong (CN)

( * ) Notice: Subject to any disclaimer, the term of this patent is extended or adjusted under 35 U.S.C. 154(b) by 24 days.

(21) Appl. No.: 15/296,393

(22) Filed: Oct. 18, 2016

(65) Prior Publication Data

US 2017/0254572 A1 Sep. 7, 2017

(30) Foreign Application Priority Data

Mar. 3, 2016 (CN) ..... 2016 1 0122428

(51) Int. Cl.
*F25B 43/00* (2006.01)
*F25B 13/00* (2006.01)
(Continued)

(52) U.S. Cl.
CPC ..... *F25B 13/00* (2013.01); *F25B 1/10* (2013.01); *F25B 41/04* (2013.01); *F25B 49/02* (2013.01);
(Continued)

(58) Field of Classification Search
CPC .... F25B 31/004; F25B 31/002; F25B 41/062; F25B 49/022
(Continued)

(56) References Cited

U.S. PATENT DOCUMENTS 3,190,011 A 6/1965 Abdalian
2006/0277690 A1 12/2006 Pyo et al.
(Continued)

FOREIGN PATENT DOCUMENTS

CN 102686792 B 4/2015
CN 104762797 A 7/2015
CN 205775361 U 12/2016

OTHER PUBLICATIONS

China Patent Office, Office action for CN application No. 201610377485.5, which is a China counterpart application of the present U.S. patent application.

*Primary Examiner* — Melvin Jones
(74) *Attorney, Agent, or Firm* — Kile Park Reed & Houtteman PLLC

(57) ABSTRACT

An air conditioning system and a method for controlling the same are provided. The air conditioning system includes an enhanced vapor injection compressor, first and second direction switching assemblies, first and second heat exchangers and a flash evaporator. The enhanced vapor injection compressor has an air discharge port, an air supplement port, first and second air suction ports, and an air return port. Pressure in a sliding vane chamber of an air cylinder corresponding to the second air suction port is equal to a discharge pressure at the air discharge port. A first pipe port of the first direction switching assembly is connected with the second air suction port, a second pipe port thereof is connected with the air discharge port and a third pipe port thereof is connected with the liquid accumulator, and the first pipe port is communicated with one of the second and third pipe ports.

12 Claims, 6 Drawing Sheets

(51) Int. Cl.
*F25B 49/02* (2006.01)
*F25B 1/10* (2006.01)
*F25B 41/04* (2006.01)

(52) U.S. Cl.
CPC ..... *F25B 2313/02741* (2013.01); *F25B 2400/075* (2013.01); *F25B 2400/13* (2013.01); *F25B 2400/23* (2013.01); *F25B 2600/2507* (2013.01); *F25B 2700/171* (2013.01); *F25B 2700/2104* (2013.01); *F25B 2700/2106* (2013.01)

(58) Field of Classification Search
USPC ..... 62/83, 115, 126, 222, 335, 498
See application file for complete search history.

(56) References Cited

U.S. PATENT DOCUMENTS

2011/0138825 A1* 6/2011 Chen ..... F25B 49/02 62/115
2012/0227426 A1* 9/2012 Deaconu ..... F25B 1/10 62/115

* cited by examiner

AIR CONDITIONING SYSTEM AND METHOD FOR CONTROLLING SAME

RELATED APPLICATIONS

This application claims priority and benefits of Chinese Patent Application No. 201610122428.2, filed with State Intellectual Property Office on Mar. 3, 2016, the entire content of which is incorporated herein by reference.

FIELD

The present disclosure relates to a technical field of refrigeration equipment, and more particularly to an air conditioning system and a method for controlling the same.

BACKGROUND

People make a higher requirement for a household air conditioner, along with social developments and popularization of household inverter air conditioners. For example, people need the air conditioner to quickly regulate a room temperature in an energy conservation way, for powerful refrigeration at a high temperature and powerful heating at a low temperature and so on. However, single-rotor compressors are adopted by most of common inverter air conditioners because of costs. Vibration and noises are large because a one-way force is applied on a rotor, and the vibration is too large especially in a case of a low frequency, which seriously influences the reliability of a whole machine. The highest operation frequency of the air conditioner cannot be too high due to the noise limitation, and the maximum capacity of the air conditioner cannot be reached. If a common double-rotor compressor is adopted, the whole machine is poor in performance because of an increased leakage of the air cylinder, which goes against energy conversation. In addition, the common double-rotor compressor having double modes can solve some of the above issues, however the performance of the system sharply degrades because of an increased compression ratio of the compressor, when the air conditioner is used for refrigeration at an ultra-high temperature and heating at an ultra-low temperature.

SUMMARY

Embodiments of the present disclosure seek to solve at least one of the problems existing in the related art to at least some extent. Therefore, the present disclosure provides an air conditioning system, which has advantages of a large power output in a case of a high frequency and a high compression ratio, and low power and vibration in a case of a low frequency.

The present disclosure further provides a method for controlling the air conditioning system above.

An air conditioning system according to the present disclosure includes an enhanced vapor injection compressor including a housing, a liquid accumulator and a compression mechanism disposed in the housing, in which the housing is provided with an air discharge port, an air supplement port, a first air suction port and a second air suction port, the liquid accumulator is provided with an air return port, the air return port is in communication with the first air suction port, the first air suction port and the second air suction port are in communication with air suction channels of two air cylinders of the compression mechanism, respectively, and a pressure in a sliding vane chamber of one air cylinder, corresponding to the second air suction port, of the compression mechanism is equal to a discharge pressure at the air discharge port; a first direction switching assembly including a first pipe port, a second pipe port and a third pipe port, in which the first pipe port is connected to the second air suction port, the second pipe port is connected to the air discharge port, the third pipe port is connected to the liquid accumulator, and the first pipe port is in communication with one of the second pipe port and the third pipe port; a second direction switching assembly having a first valve port, a second valve port, a third valve port and a fourth valve port, in which the first valve port is in communication with one of the second valve port and the third valve port, the fourth valve port is in communication with the other one of the second valve port and the third valve port, and the first valve port and the fourth valve port are connected to the air discharge port and the air return port, respectively; a first heat exchanger having a first end connected with the second valve port and a second end; a second heat exchanger having a first end connected with the third valve port and a second end; and a flash evaporator having an air outlet, a first port and a second port, in which the air outlet is connected to the air supplement port, the first port is connected with the second end of the first heat exchanger, the second port is connected with the second end of the second heat exchanger, a first throttling element is connected in series between the first port and the first heat exchanger, and a second throttling element is connected in series between the second port and the second heat exchanger.

An operation mode of the air conditioning system according to the present disclosure can be freely switched between a single-rotor operation mode and a double-rotor operation mode, by using an enhanced vapor injection compressor having a variable capacity. Thus, the double-rotor operation mode can be adopted to raise refrigerating and heating speeds, when the air conditioning system needs large power output for refrigeration at a high temperature and heating at a low temperature. Furthermore, the single-rotor operation mode can be adopted by bypassing one rotor, when the air conditioning system is used for refrigeration at a low temperature and heating at a high temperature, thus achieving low vibration, low power and high energy efficiency.

In some embodiments of the present disclosure, the second direction switching assembly is a four-way valve.

In some embodiments of the present disclosure, the first direction switching assembly is a three-way valve.

In some embodiments of the present disclosure, each throttling element is an electronic expansion valve.

The method for controlling the air conditioning system according to embodiments of the present disclosure includes:

detecting an operation mode of the air conditioning system, an indoor temperature T1, an outdoor temperature T4 and a user-set temperature TS;

detecting whether the outdoor temperature T4 is larger than a first set temperature T2, when the air conditioning system is in a refrigerating mode, controlling the first direction switching assembly to communicate the first pipe port with the third pipe port if the outdoor temperature T4 is larger than the first set temperature T2; controlling the direction switching assembly to communicate the first pipe port with the third pipe port, if T4 is less than or equal to the first set temperature T2 and it is detected that a first difference value T1−TS between the indoor temperature T1 and the user-set temperature TS is larger than or equal to a second set temperature T3; and controlling the first direction switching assembly to communicate the first pipe port with the second pipe port, if the outdoor temperature T4 is less than or equal to the first set temperature T2 and it is detected that the first difference value T1−TS is less than the second set temperature T3; and detecting whether the outdoor temperature T4 is larger than a third set temperature T5, when the air conditioning system is in a heating mode, controlling the first direction switching assembly to communicate the first pipe port with the third pipe port, if the outdoor temperature T4 is less than or equal to the third set temperature T5; controlling the first direction switching assembly to communicate the first pipe port with the third pipe port, if the outdoor temperature T4 is larger than the third set temperature T5 and it is detected that a second difference value TS−T1 between the user-set temperature TS and the indoor temperature T1 is larger than or equal to a fourth set temperature T6; and controlling the first direction switching assembly to communicate the first pipe port with the second pipe port, if the outdoor temperature T4 is larger than the third set temperature T5 and it is detected that TS−T1 is less than T6.

In some embodiments of the present disclosure, a value range of the second set temperature T3 is the same with a value range of the fourth set temperature T6.

Furthermore, the value range of the second set temperature T3 is from 3° C. to 5° C., and the value range of the fourth set temperature T6 is from 3° C. to 5° C.

In some embodiments of the present disclosure, a value range of the first set temperature T2 is from 30° C. to 40° C.

In some embodiments of the present disclosure, a value range of the third set temperature T5 is from 10° C. below zero to 5° C. below zero.

Additional aspects and advantages of embodiments of present disclosure will be given in part in the following descriptions, become apparent in part from the following descriptions, or be learned from the practice of the embodiments of the present disclosure.

Figure 1:
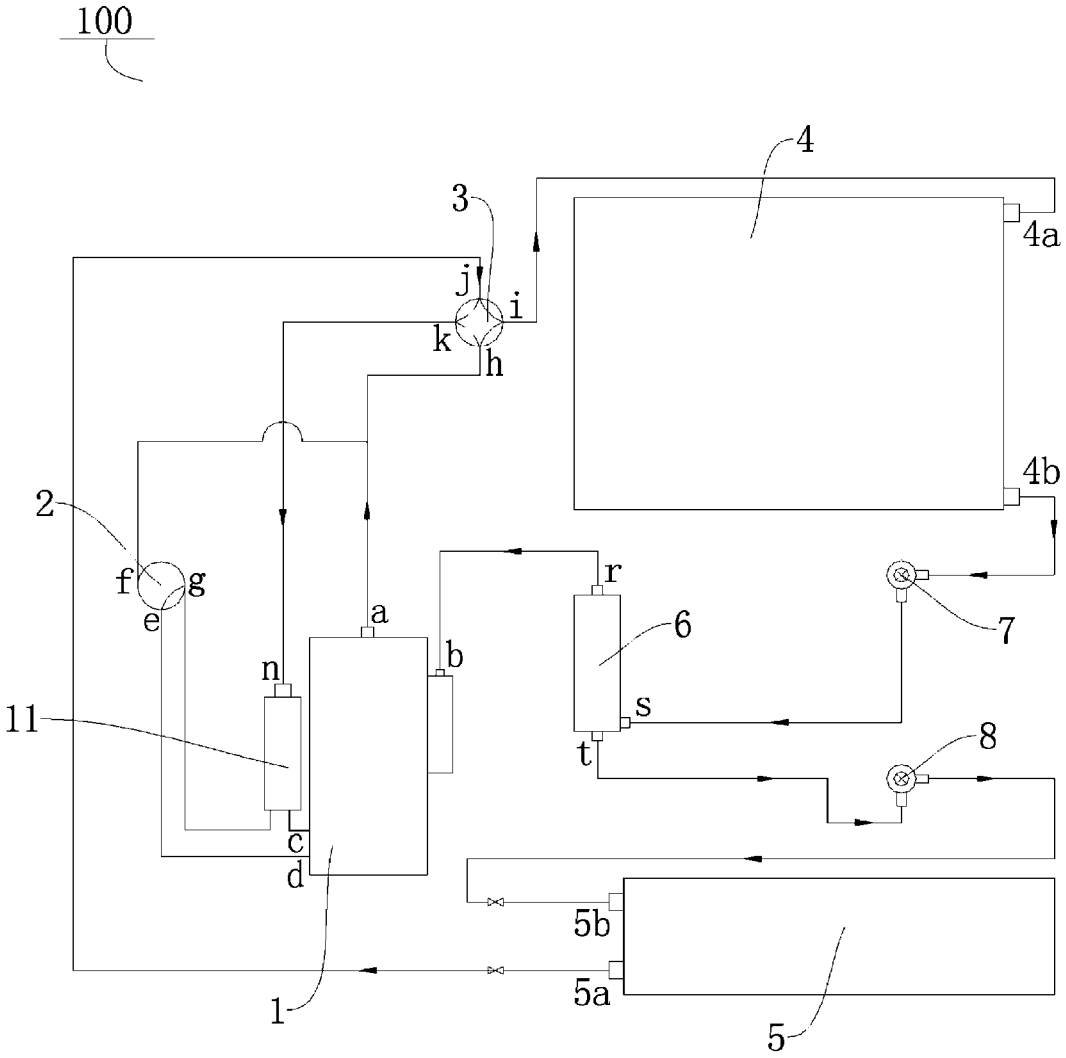
FIG. 1 is a schematic view of an air conditioning system according to embodiments of the disclosure, in which the air conditioning system is in a double-rotor refrigerating mode.

REFERENCE NUMERALS air conditioning system 100, enhanced vapor injection compressor 1, air discharge port a, air supplement port b, first air suction port c, second air suction port d, liquid accumulator 11, air return port n, first direction switching assembly 2, first pipe port e, second pipe port f, third pipe port g, second direction switching assembly 3, first valve port h, second valve port i, third valve port j, fourth valve port k, outdoor heat exchanger 4, indoor heat exchanger 5, flash evaporator 6, air outlet r, first port s, second port t, first throttling element 7, second throttling element 8.

DETAILED DESCRIPTION

Reference will be made in detail to embodiments of the present disclosure. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

Various embodiments and examples are provided in the following description to implement different structures of the present disclosure. In order to simplify the present disclosure, certain elements and settings will be described. However, these elements and settings are only by way of example and are not intended to limit the present disclosure. In addition, reference numerals and/or letters may be repeated in different examples in the present disclosure. This repeating is for the purpose of simplification and clarity and does not refer to relations between different embodiments and/or settings. Furthermore, examples of different processes and materials are provided in the present disclosure. However, it would be appreciated by those skilled in the art that other processes and/or materials may be also applied.

An air conditioning system 100 according to embodiments of the present disclosure is described below with reference to FIG. 1 to FIG. 6.

As shown in FIG. 1, an air conditioning system 100 according to an embodiment of the present disclosure includes an enhanced vapor injection compressor 1, a first direction switching assembly 2, a second direction switching assembly 3, first and second heat exchangers (such as an outdoor heat exchanger 4 and an indoor heat exchanger 5 shown in FIG. 1) and a flash evaporator 6.

Specifically, the enhanced vapor injection compressor 1 includes a housing, a liquid accumulator 11, and a compression mechanism disposed in the housing. The housing is provided with an air discharge port a, an air supplement port b, a first air suction port c and a second air suction port d. The liquid accumulator 11 is provided with an air return port n, and the air return port n is in communication with the first air suction port c. The first air suction port c and the second air suction port d are in communication with air suction channels of two air cylinders (i.e., a first air cylinder and a second air cylinder) of the compression mechanism, respectively. A pressure in a sliding vane chamber of one air cylinder (i.e., the second air cylinder), corresponding to the second air suction port d, of the compression mechanism is equal to a discharge pressure at the air discharge port a, so that the pressure in the sliding vane chamber of the air cylinder corresponding to the second air suction port d is always a high pressure.

Figure 2:
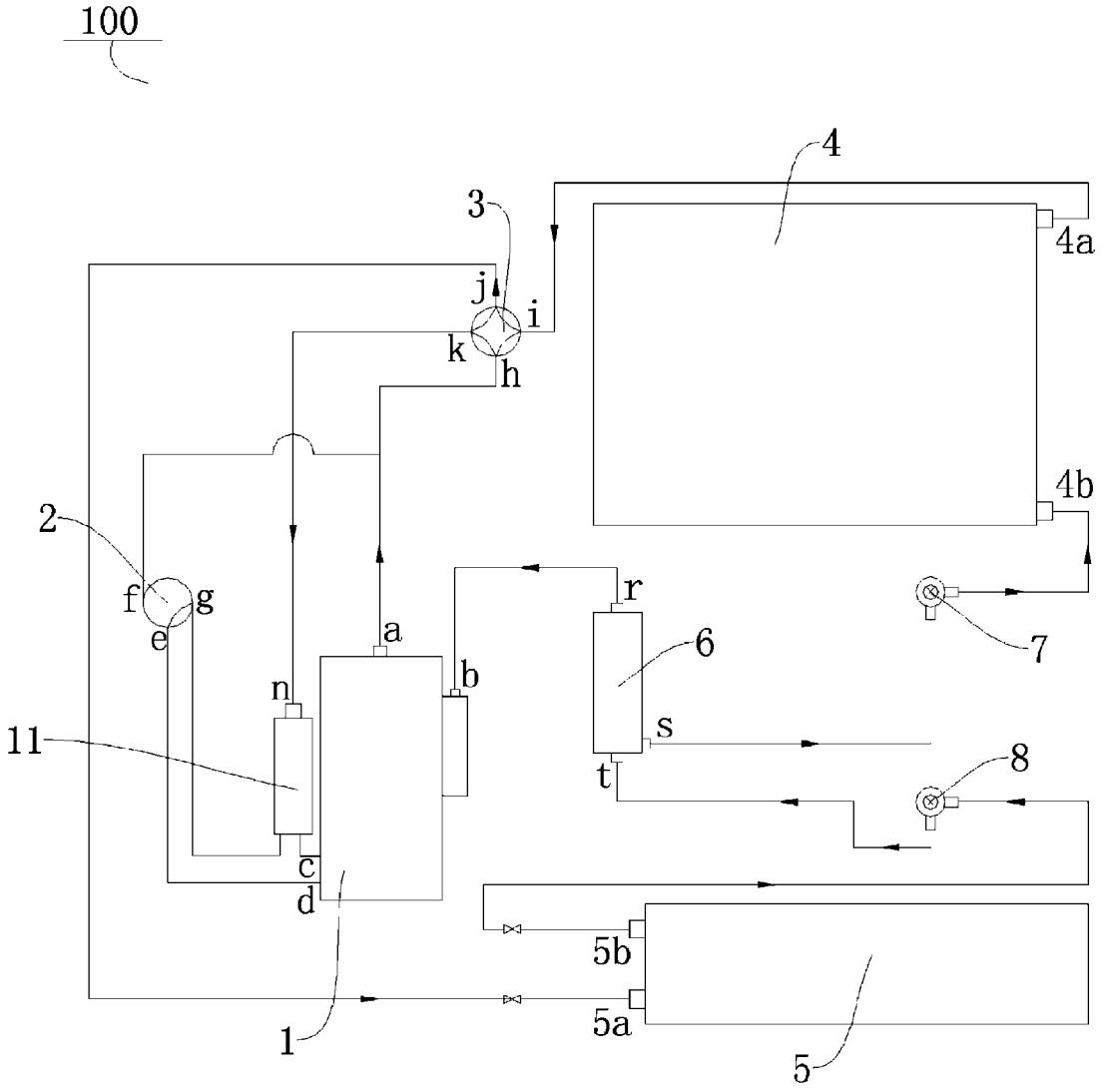
FIG. 2 is a schematic view of the air conditioning system according to embodiments of the disclosure, in which the air conditioning system is in a double-rotor heating mode.
Figure 3:
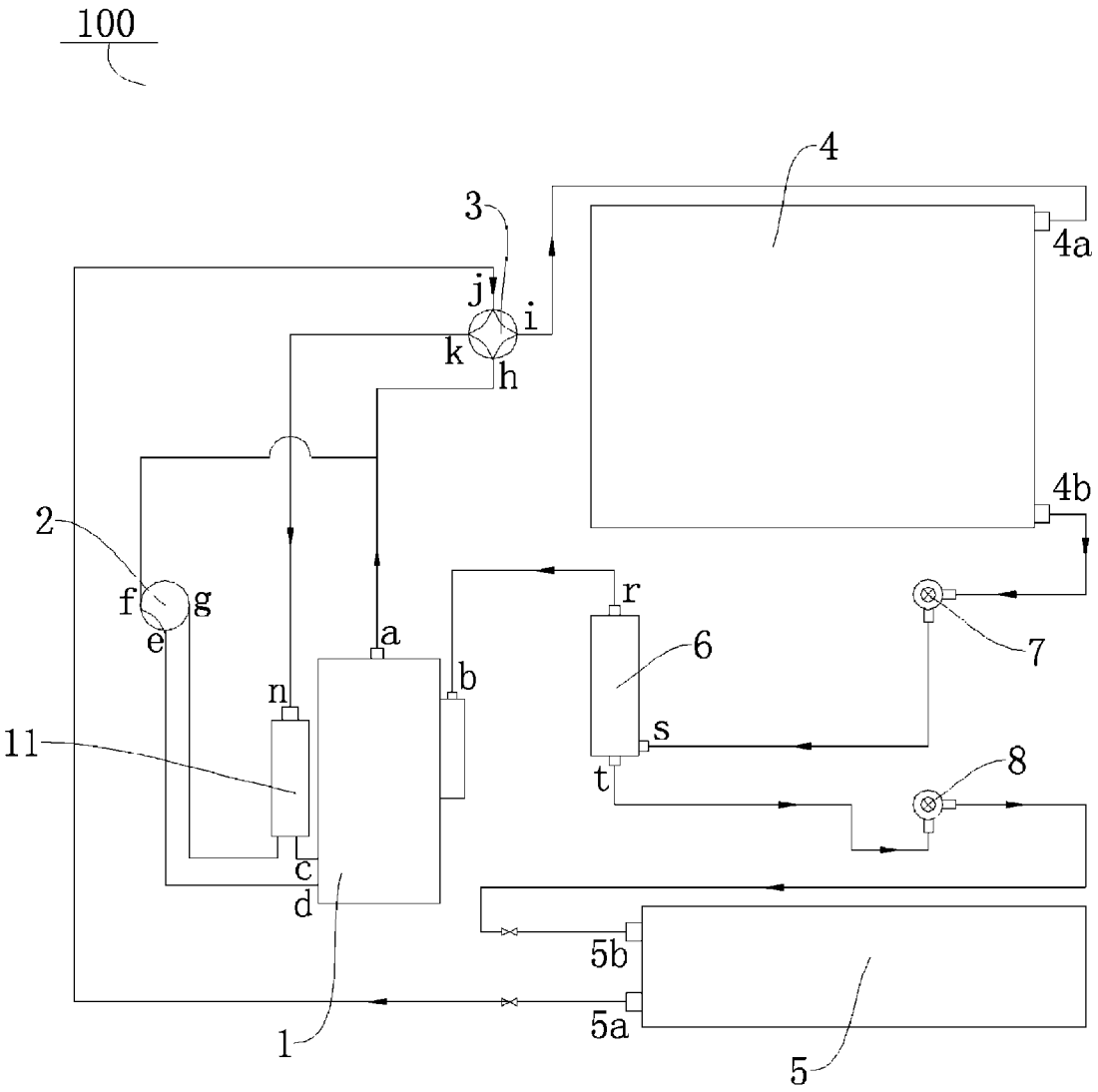
FIG. 3 is a schematic view of the air conditioning system according to embodiments of the disclosure, in which the air conditioning system is in a single-rotor refrigerating mode.
Figure 4:
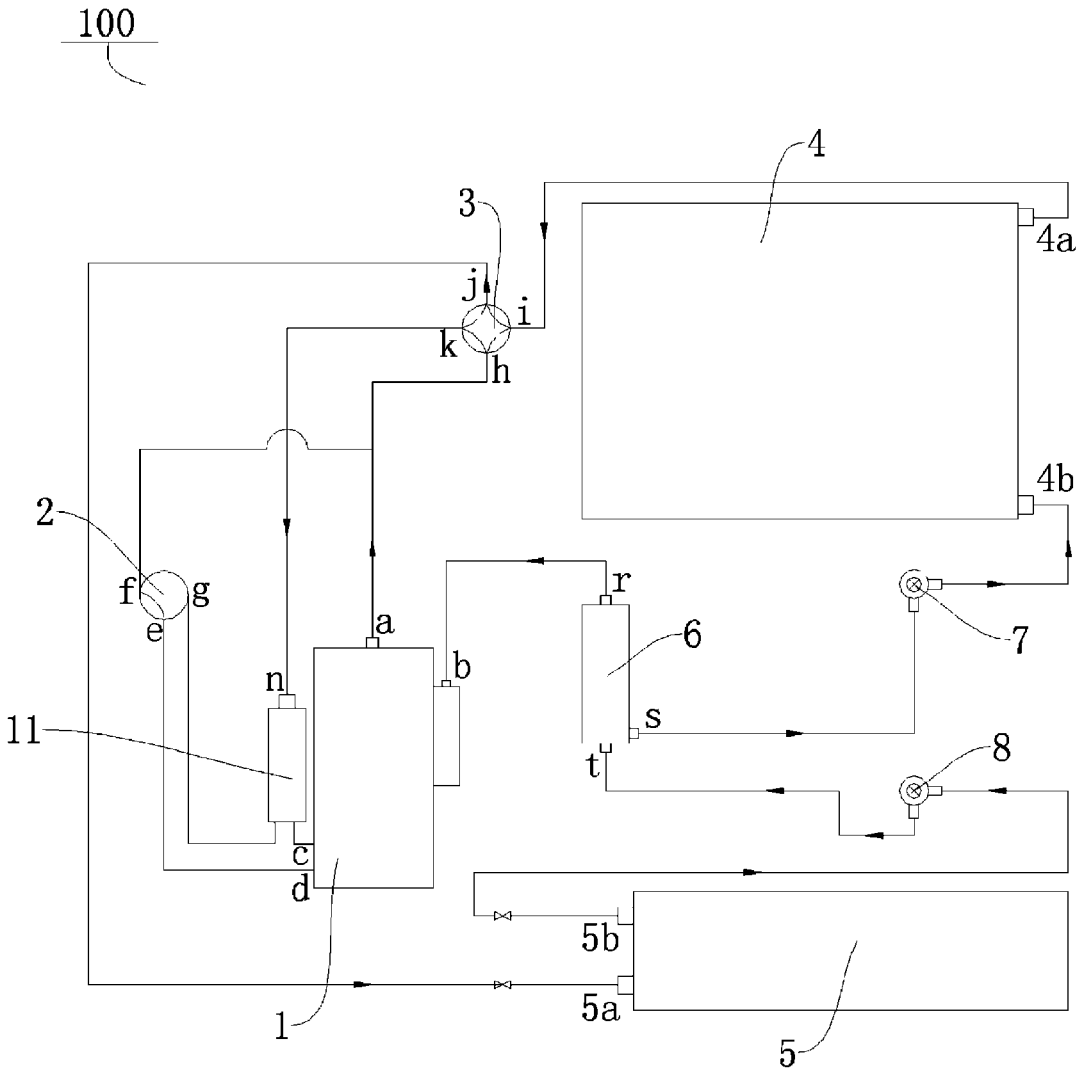
FIG. 4 is a schematic view of an air conditioning system according to embodiments of the disclosure, in which the air conditioning system is in a single-rotor heating mode.

The first direction switching assembly 2 includes a first pipe port e, a second pipe port f and a third pipe port g. The first pipe port e is connected to the second air suction port d, the second pipe port f is connected to the air discharge port a, the third pipe port g is connected to the liquid accumulator 11, and the first pipe port e is in communication with one of the second pipe port f and the third pipe port g. As shown in FIG. 3 and FIG. 4, when the first pipe port e is in communication with the second pipe port f, the air discharge port a of the enhanced vapor injection compressor 1 is in communication with the second air suction port d of the enhanced vapor injection compressor 1, so that both of a pressure in the air suction channel of the air cylinder corresponding to the second air suction port d and the pressure in the sliding vane chamber of such air cylinder are equal to the discharge pressure. At this time, forces applied to a sliding vane in such air cylinder are balanced in a radial direction, and the sliding vane stops in a sliding vane groove. A piston in such air cylinder idles rather than compresses, and the enhanced vapor injection compressor 1 operates in a single-rotor operation mode. As shown in FIG. 1 and FIG. 2, when the first pipe port e is in communication with the third pipe port g, the first air suction port c of the enhanced vapor injection compressor 1 is in communication with the second air suction port d of the enhanced vapor injection compressor 1, the pressure in the air cylinder communicated with (i.e., being corresponding to) the second air suction port d is an intake pressure and less than the pressure (which is equal to the discharge pressure) in the sliding vane chamber of such air cylinder. The sliding vane comes out of the sliding vane chamber and contacts the piston under the action of a radial force, so that the air cylinder can normally compress, and thus the enhanced vapor injection compressor 1 operates in a double-rotor operation mode.

In short, an operation mode of the enhanced vapor injection compressor 1 can be controlled by communicating the first pipe port e of the first direction switching assembly 2 with the second pipe port f of the first direction switching assembly 2, or communicating the first pipe port e of the first direction switching assembly 2 with the third pipe port g of the first direction switching assembly 2, i.e., only one air cylinder may be adopted for compression, or two air cylinders may be adopted for compression at the same time. In this way, the operation mode of the enhanced vapor injection compressor 1 can be switched between the single-rotor operation mode and the double-rotor operation mode.

The second direction switching assembly 3 has a first valve port h, a second valve port i, a third valve port j and a fourth valve port k. The first valve port h is in communication with one of the second valve port i and the third valve port j, and the fourth valve port k is in communication with the other one of the second valve port i and the third valve port j. That is, the fourth valve port k is in communication with the third valve port j when the first valve port h is in communication with the second valve port i, and the fourth valve port k is in communication with the second valve port i when the first valve port h is in communication with the third valve port j.

Preferably, the second direction switching assembly 3 is a four-way valve. The first valve port h is in communication with the second valve port i, and the third valve port j is in communication with the fourth valve port k, when the air conditioning system 100 operates in a refrigerating mode. The first valve port h is in communication with the third valve port j, and the second valve port i is in communication with the fourth valve port k, when the air conditioning system 100 operates in a heating mode. Of course, the present disclosure is not limited to this, and the second direction switching assembly 3 may be another element, as long as the second direction switching assembly has the first valve port h to the fourth valve port k and the direction switch among these ports can be realized.

The first valve port h and the fourth valve port k are connected to the air discharge port a and the air return port n, respectively. A refrigerant enters the liquid accumulator 11 after passing through the fourth valve port k of the second direction switching assembly 3 and the air return port n in turn, and then returns into the enhanced vapor injection compressor 1. The refrigerant in the air cylinder is compressed into a refrigerant having a high temperature and a high pressure, and then the refrigerant having the high temperature and the high pressure is discharged from the air discharge port a to the first valve port h. It should be pointed out that, a principle of compressing the refrigerant by the enhanced vapor injection compressor 1 is known from the prior art, and thus will not be described in detail herein.

The first heat exchanger (i.e. the outdoor heat exchanger 4 shown in FIG. 1) has a first end connected with the second valve port i, and the second heat exchanger (i.e. the indoor heat exchanger 5 shown in FIG. 1) has a first end connected with the third valve port j. As shown in FIG. 1, a first end 4*a* of the outdoor heat exchanger 4 is connected to the second valve port i, and a first end 5*a* of the indoor heat exchanger 5 is connected to the third valve port j.

The flash evaporator 6 has an air outlet r and two inlets/outlets (such as a first port s and a second port t shown in FIG. 1), the air outlet r is connected to the air supplement port b, so a gaseous refrigerant separated in the flash evaporator 6 can return into the enhanced vapor injection compressor 1 to be compressed through the air supplement port b, so as to improve the whole performance of the air conditioning system 100.

The two ports are connected to second ends of the first and second heat exchangers, respectively. A throttling element (such as a first throttling element 7 or a second throttling element 8 shown in FIG. 1) is connected in series between each port and the corresponding heat exchanger. As shown in FIG. 1, the first port s is connected to a second end 4*b* of the outdoor heat exchanger 4, the first throttling element 7 is connected in series between the first port s and the outdoor heat exchanger 4, the second port t is connected to a second end 5*b* of the indoor heat exchanger 5, and the second throttling element 8 is connected in series between the second port t and the indoor heat exchanger 5, in which both of the first throttling element 7 and the second throttling element 8 are used for throttling and reducing pressure.

Preferably, each throttling element is an electronic expansion valve. Of course, the present disclosure is not limited to this, and the throttling element may be a capillary or a combination of the capillary tube and the electronic expansion valve, as long as the throttling element can be used for throttling and reducing pressure.

An operation mode of the air conditioning system 100 according to the embodiment of the present disclosure can be freely switched between the single-rotor operation mode and the double-rotor operation mode, by using the enhanced vapor injection compressor 1 having a variable capacity. Thus, a double-rotor mode can be adopted to raise refrigerating and heating speeds, when the air conditioning system 100 needs large power output for refrigeration at a high temperature and heating at a low temperature. Furthermore, a single-rotor mode can be adopted by bypassing one rotor, when the air conditioning system 100 is used for refrigerating at a low temperature and heating at a high temperature, thus achieving low vibration, low power and high energy efficiency.

Preferably, the first direction switching assembly 2 is a three-way valve. Of course, it is to be understood that the first direction switching assembly 2 may be another structure, as long as the first direction switching assembly 2 has the first pipe port e to the third pipe port g and the direction switch among these ports can be realized.

It is to be understood that the three-way valve also may be replaced by other valves having the same functions, such as a four-way valve. A commonly used four-way valve has four ports (a port A, a port B, a port C and a port D), and the four-way valve can be changed into a three-way valve by adopting the following methods in the present disclosure.

1. The port D of the four-way valve is blocked, the port B is connected to the second air suction port d of the enhanced vapor injection compressor 1 having the variable capacity, the port A and the port C are connected to the air discharge port a and the liquid accumulator 11 of the enhanced vapor injection compressor 1 having the variable capacity without a specific connection sequence, respectively.

2. The port B of the four-way valve is blocked, the port D is connected to the second air suction port d of the enhanced vapor injection compressor 1 having the variable capacity, the port A and the port C are connected to the air discharge port a and the liquid accumulator 11 of the enhanced vapor injection compressor 1 having the variable capacity without a specific connection sequence, respectively.

3. The port A of the four-way valve is blocked, the port C is connected to the second air suction port d of the enhanced vapor injection compressor 1 having the variable capacity, the port B and the port D are connected to the air discharge port a and the liquid accumulator 11 of the enhanced vapor injection compressor 1 having the variable capacity without a specific connection sequence, respectively.

4. The port C of the four-way valve is blocked, the port A is connected to the second air suction port d of the enhanced vapor injection compressor 1 having the variable capacity, the port B and the port D are connected to the air discharge port a and the liquid accumulator 11 of the enhanced vapor injection compressor 1 having the variable capacity without a specific connection sequence, respectively.

A method for controlling the air conditioning system 100 according to the embodiments of the present disclosure is described below with reference to FIG. 5 and FIG. 6.

Figure 5:
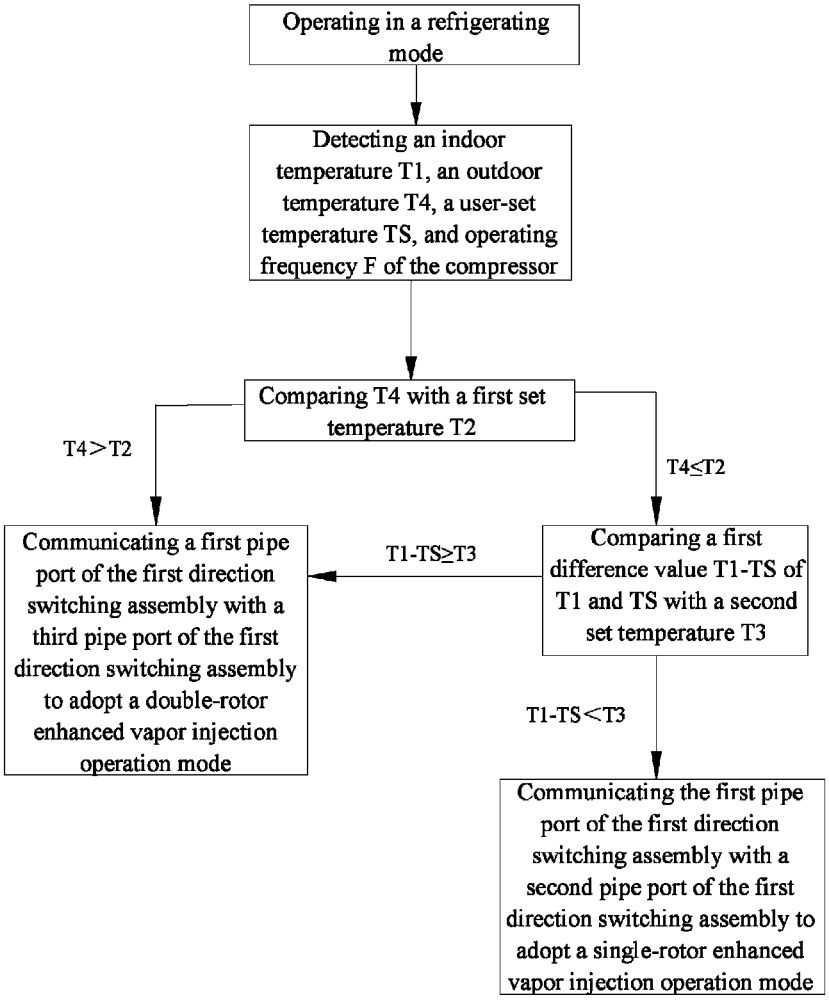
FIG. 5 is a flow chart of a method for controlling an air conditioning system according to embodiments of the present disclosure, in which the air conditioning system is in a refrigerating mode.
Figure 6:
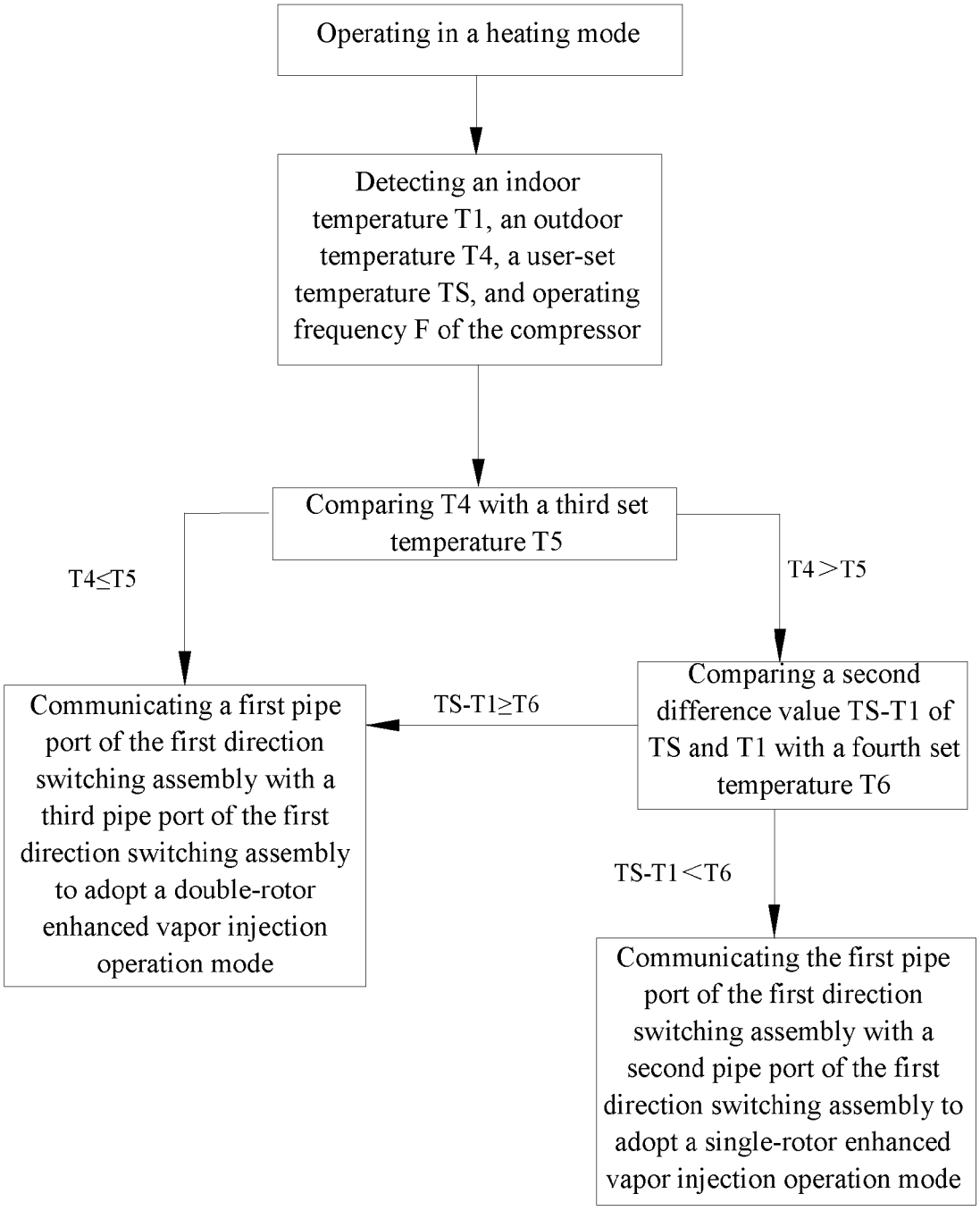
FIG. 6 is a flow chart of a method for controlling an air conditioning system according to embodiments of the present disclosure, in which the air conditioning system is in a heating mode.

As shown in FIG. 5 and FIG. 6, the method for controlling the air conditioning system 100 according to the embodiments of the present disclosure includes the following steps.

An operation mode of the air conditioning system 100, an indoor temperature T1, an outdoor temperature T4 and a user-set temperature TS are detected.

It is detected whether the outdoor temperature T4 is larger than a first set temperature T2, when the air conditioning system 100 is in a refrigerating mode, and the first direction switching assembly 2 is controlled to communicate the first pipe port e with the third pipe port g, if the outdoor temperature T4 is larger than the first set temperature T2, so as to adopt a double-rotor enhanced vapor injection operation mode; the direction switching assembly 2 is controlled to communicate the first pipe port e with the third pipe port g, if the outdoor temperature T4 is less than or equal to the first set temperature T2 and it is detected that a first difference value T1−TS between the indoor temperature T1 and the user-set temperature TS is larger than or equal to a second set temperature T3, so as to adopt the double-rotor enhanced vapor injection operation mode; and the first direction switching assembly 2 is controlled to communicate the first pipe port e with the second pipe port f, if the outdoor temperature T4 is less than or equal to the first set temperature T2 and it is detected that the first difference value T1−TS is less than the second set temperature T3, so as to adopt a single-rotor enhanced vapor injection operation mode.

It is detected whether the outdoor temperature T4 is larger than a third set temperature T5, when the air conditioning system 100 operates in a heating mode, and the first direction switching assembly 2 is controlled to communicate the first pipe port e with the third pipe port g, if the outdoor temperature T4 is less than or equal to the third set temperature T5, so as to adopt the double-rotor enhanced vapor injection operation mode; the first direction switching assembly 2 is controlled to communicate the first pipe port e with the third pipe port g, if the outdoor temperature T4 is larger than the third set temperature T5 and it is detected that a second difference TS−T1 between the user-set temperature TS and the indoor temperature T1 is larger than or equal to a fourth set temperature T6, so as to adopt the double-rotor enhanced vapor injection operation mode; and the first direction switching assembly 2 is controlled to communicate the first pipe port e with the second pipe port f, if the outdoor temperature T4 is larger than the third set temperature T5 and it is detected that the second difference value TS−T1 is less than the fourth set temperature T6, so as to adopt the single-rotor enhanced vapor injection operation mode.

With the method for controlling the air conditioning system 100 according to the embodiments of the present disclosure, the double-rotor enhanced vapor injection operation mode is adopted for achieving large power output in a case of a high compression ratio to raise refrigerating and heating speeds, when the large power output is needed for refrigeration at a high temperature and heating at a low temperature; and the single-rotor enhanced vapor injection operation mode can be chosen by bypassing one rotor, when the low power output is needed for refrigeration at a low temperature and heating at a high temperature, thus achieving low vibration, low power and high energy efficiency, so that the air conditioning system 100 can operate without stop when bearing a low load, to keep stability of temperature along with low temperature fluctuation, which is energy efficient and comfortable.

In an embodiment of the present disclosure, a value range of the second set temperature T3 is the same with a value range of the fourth set temperature T6, to simplify a control program of the air conditioning system 100.

Furthermore, the value range of the second set temperature T3 is from 3° C. to 5° C., and the value range of the fourth set temperature T6 is from 3° C. to 5° C. So the single-rotor enhanced vapor injection operation mode is adopted when a difference value between the indoor temperature and the user-set temperature is less than the second set temperature T3 or the fourth set temperature T6 which ranges from 3° C. to 5° C., to keep the stability of temperature with low temperature fluctuation, which is energy efficient and comfortable.

In an embodiment of the present disclosure, because the first set temperature T2 corresponds to a case in which quick refrigeration at a high temperature is needed, and the third temperature T5 corresponds to a case in which quick heating at a low temperature is needed, a value range of the first set temperature T2 may be from 30° C. to 40° C., and a value range of the third set temperature T5 may be from 10° C. below zero to 5° C. below zero, so as to make the first set temperature T2 and the third set temperature T5 more reasonable.

An air conditioning system 100 according to a specific embodiment of the present disclosure is described below with reference to FIG. 1 to FIG. 6.

Referring to FIG. 1, the air conditioning system 100 includes an enhanced vapor injection compressor 1, a first direction switching assembly 2, a second direction switching assembly 3, an outdoor heat exchanger 4, an indoor heat exchanger 5, a flash evaporator 6, a first throttling element 7 and a second throttling element 8, in which the first direction switching assembly 2 is a three-way valve, the second direction switching assembly 3 is a four-way valve, and both of the first throttling element 7 and the second throttling element 8 are electronic expansion valves.

Specifically, as shown in FIG. 1, the enhanced vapor injection compressor 1 includes a housing, a liquid accumulator 11 and a compression mechanism. The housing is provided with an air discharge port a, an air supplement port b, a first air suction port c and a second air suction port d. The liquid accumulator 11 is provided with an air return port n. The three-way valve has a first pipe port e, a second pipe port f and a third pipe port g. The four-way valve has a first valve port h, a second valve port i, a third valve port j and a fourth valve port k. The flash evaporator 6 has an air outlet r, a first port s and a second port t.

The first air suction port c is in communication with an air suction channel of a first air cylinder, and the second air suction port d is in communication with an air suction channel of a second air cylinder. The first valve port h of the four-way valve is connected to the air discharge port a, the second valve port i is connected to a first end 4*a* of the outdoor heat exchanger 4, the third valve port j is connected to a first end 5*a* of the indoor heat exchanger 5, the fourth valve port k is connected to the air return port n, and the air return port n is in communication with the first air suction port c. The first pipe port e of the three-way valve is in communication with the second air suction port d, the second pipe port f is in communication with the air discharge port a, and the third pipe port g is connected to the liquid accumulator 11. The air outlet r of the flash evaporator 6 is connected to the air supplement port b, the first throttling element 7 is connected in series between the first port s and a second end 4*b* of the outdoor heat exchanger 4, and the second throttling element 8 is connected in series between the second port t and a second end 5*b* of the indoor heat exchanger 5.

As shown in FIG. 1 and FIG. 3, the first valve port h of the four-way valve is in communication with the second valve port i of the four-way valve, and the fourth valve port k is in communication with the third valve port j, when the air conditioning system 100 operates in a refrigerating mode.

A flow direction of refrigerant is shown as follows. The refrigerant discharged from the air discharge port a of the enhanced vapor injection compressor 1 enters the outdoor heat exchanger 4 after passing through the first valve port h and the second valve port i of the four-way valve, then is discharged from the second end 4*b* of the outdoor heat exchanger 4 after exchanging heat with an outdoor environment in the outdoor heat exchanger 4, and then enters the flash evaporator 6 through the first port s to be separated into a gaseous refrigerant and a liquid refrigerant, after being subjected to throttling and pressure reduction by the first throttling element 7.

The liquid refrigerant separated by the flash evaporator 6 flows out of the second port t, enters the indoor heat exchanger 5 after being subjected to throttling and pressure reduction by the second throttling element 8, and exchanges heat with an indoor environment in the indoor heat exchanger 5 to refrigerate the indoor environment. The refrigerant discharged from the indoor heat exchanger 5 enters the liquid accumulator 11 through the air return port n, after passing through the third valve port j and the fourth valve port k of the four-way valve, and then returns to the enhanced vapor injection compressor 1 through the first air suction port c. Such whole process is repeated for refrigeration. The gaseous refrigerant separated by the flash evaporator 6 returns into the enhanced vapor injection compressor 1 from the air outlet r through the air supplement port b, so as to be compressed.

As shown in FIG. 1, the first pipe port e of the three-way valve is in communication with the third pipe port g of the three-way valve, when the air conditioning system 100 operates in a double-rotor refrigerating mode. At this time, the refrigerant in the liquid accumulator 11 may enter the air suction channel of the second air cylinder to be compressed, through the second air suction port d after passing the third pipe port g and the first pipe port e.

As shown in FIG. 3, the first pipe port e of the three-way valve is in communication with the second pipe port f of the three-way valve, when the air conditioning system 100 operates in a single-rotor refrigerating mode. At this time, the refrigerant discharged from the air discharge port a enters the second air cylinder after passing through the second pipe port f, the first pipe port e and the second air suction port d sequentially, so that a pressure in the second air cylinder is the same with that in a sliding vane chamber of the second air cylinder, and thus a piston in the second air cylinder idles and does not compress.

As shown in FIG. 2 to FIG. 4, the first valve port h of the four-way valve is in communication with the third valve port j of the four-way valve, and the fourth valve port k is in communication with the second valve port i, when the air conditioning system 100 operates in a heating mode.

The flow direction of refrigerant is shown as follows. The refrigerant discharged from the enhanced vapor injection compressor 1 enters the indoor heat exchanger 5 after passing through the first valve port h and the third valve port j of the four-way valve, and exchanges heat with the indoor environment in the indoor heat exchanger 5 to heat the indoor environment. The refrigerant discharged from the indoor heat exchanger 5 enters the flash evaporator 6 to be separated into the gaseous refrigerant and the liquid refrigerant, after going through throttling and pressure reduction by the second throttling element 8.

The liquid refrigerant separated by the flash evaporator 6 is discharged into the outdoor heat exchanger 4 after going through throttling and pressure reduction by the first throttling element 7, and exchanges heat with the outdoor environment in the outdoor heat exchanger 4. The refrigerant discharged from the outdoor heat exchanger 4 enters the liquid accumulator 11 through the air return port n, after passing through the second valve port i and the fourth valve port k of the four-way valve, and then returns into the enhanced vapor injection compressor 1 through the first air suction port c. Such whole process is repeated to complete heating. The gaseous refrigerant separated by the flash evaporator 6 returns into the enhanced vapor injection compressor 1 from the air outlet r through the air supplement port b, so as to be compressed.

As shown in FIG. 2, the first pipe port e of the three-way valve is in communication with the third pipe port g of the three-way valve, similar to the double-rotor refrigerating mode, when the air conditioning system 100 operates in a double-rotor heating mode.

As shown in FIG. 4, the first pipe port e of the three-way valve is in communication with the second pipe port f of the three-way valve, similar to the single-rotor refrigerating mode, when the air conditioning system 100 operates in a single-rotor heating mode.

A method for controlling the air conditioning system 100 according to the above embodiment is described below and includes following steps.

A first set temperature T2 is set as 32° C., a second set temperature T3 is set as 3° C., a third set temperature T5 is set as 5° C., and a fourth set temperature T6 is set as 3° C.

An operation mode of the air conditioning system 100, an indoor temperature T1, an outdoor temperature T4, and a user-set temperature TS are detected, as shown in FIG. 5 and FIG. 6, It is detected whether the outdoor temperature T4 is larger than 32° C. when the air conditioning system 100 operates in a refrigerating mode, as shown in FIG. 5, and the first direction switching assembly 2 is controlled to communicate the first pipe port e with the third pipe port g, so as to adopt a double-rotor enhanced vapor injection mode, if T4>32° C.; the first direction switching assembly 2 is controlled to communicate the first pipe port e with the third pipe port g, so as to adopt the double-rotor enhanced vapor injection mode, if T4≤32° C. and it is detected that T1−TS≥3° C.; and the first direction switching assembly 2 is controlled to communicate the first pipe port e with the second pipe port f, so as to adopt a single-rotor enhanced vapor injection mode, if T4≤32° C. and it is detected that T1−TS<3° C.

It is detected whether the outdoor temperature T4 is larger than 5° C. when the air conditioning system 100 operates in a heating mode, as shown in FIG. 6, and the first direction switching assembly 2 is controlled to communicate the first pipe port e with the third pipe port g, so as to adopt the double-rotor enhanced vapor injection mode, if T4≤5° C.; the first direction switching assembly 2 is controlled to communicate the first pipe port e with the third pipe port g, so as to adopt the double-rotor enhanced vapor injection mode, if T4>5° C. and it is detected that TS−T1≥3° C.; and the first direction switching assembly 2 is controlled to communicate the first pipe port e with the second pipe port f, so as to adopt the single-rotor enhanced vapor injection mode, if T4>5° C. and it is detected that TS−T1<3° C.

The enhanced vapor injection compressor 1 is adopted by the air conditioning system 100 according to the embodiments of the present disclosure, a double-rotor operation mode is adopted for achieving large power output in a case of a high compression ratio to raise refrigerating and heating speeds, when the large power output is needed for refrigeration at a high temperature and heating at a low temperature; and a single-rotor operation mode can be chosen by bypassing one rotor, when low energy output is needed for refrigeration at a low temperature and heating at a high temperature, thus achieving low vibration, low power and high energy efficiency, so that the air conditioning system 100 can operate without stop when bearing a low load, to keep the stability of temperature with low temperature fluctuation, which is energy efficient and comfortable.

In the description, unless specified or limited otherwise, it is to be understood that phraseology and terminology used herein with reference to device or element orientation (for example, terms like "central", "upper", "lower", "internal", "external" and the like) should be construed to refer to the orientation as then described or as shown in the drawings under discussion for simplifying the description of the present disclosure, but do not alone indicate or imply that the device or element referred to must have a particular orientation. Moreover, it is not required that the present disclosure is constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections, communication; may also be direct connections or indirect connections via intervening structures; may also be inner communications of two elements, which can be understood by those skilled in the art according to specific situations.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. An air conditioning system comprising:

an enhanced vapor injection compressor comprising a housing, a liquid accumulator and a compression mechanism disposed in the housing, wherein the housing is provided with an air discharge port, an air supplement port, a first air suction port and a second air suction port; wherein the liquid accumulator is provided with an air return port, the air return port is in communication with the first air suction port; and wherein the first air suction port and the second air suction port are in communication with air suction channels of two air cylinders of the compression mechanism, respectively, and a pressure in a sliding vane chamber of one air cylinder, corresponding to the second air suction port, of the compression mechanism is equal to a discharge pressure at the air discharge port;

a first direction switching assembly comprising a first pipe port, a second pipe port and a third pipe port, wherein the first pipe port is connected to the second air suction port, the second pipe port is connected to the air discharge port, the third pipe port is connected to the liquid accumulator, and the first pipe port is in communication with one of the second pipe port and the third pipe port;

a second direction switching assembly having a first valve port, a second valve port, a third valve port and a fourth valve port, wherein the first valve port is in communication with one of the second valve port and the third valve port, the fourth valve port is in communication with the other one of the second valve port and the third valve port, and the first valve port and the fourth valve port are connected to the air discharge port and the air return port, respectively;

a first heat exchanger having a first end connected with the second valve port and a second end;

a second heat exchanger having a first end connected with the third valve port and a second end; and a flash evaporator having an air outlet, a first port and a second port, wherein the air outlet is connected to the air supplement port, the first port is connected with the second end of the first heat exchanger, the second port is connected with the second end of the second heat exchanger, a first throttling element is connected in series between the first port and the first heat exchanger, and a second throttling element is connected in series between the second port and the second heat exchanger.

2. The air conditioning system according to claim 1, wherein the second direction switching assembly is a four-way valve.

3. The air conditioning system according to claim 1, wherein the first direction switching assembly is a three-way valve.

4. The air conditioning system according to claim 1, wherein each of the first throttling element and the second throttling element is an electronic expansion valve.

5. A method for controlling an air conditioning system, wherein the air conditioning system comprises:

an enhanced vapor injection compressor comprising a housing, a liquid accumulator and a compression mechanism disposed in the housing, wherein the housing is provided with an air discharge port, an air supplement port, a first air suction port and a second air suction port; wherein the liquid accumulator is provided with an air return port, the air return port is in communication with the first air suction port; and wherein the first air suction port and the second air suction port are in communication with air suction channels of two air cylinders of the compression mechanism, respectively, and a pressure in a sliding vane chamber of one air cylinder, corresponding to the second air suction port, of the compression mechanism is equal to a discharge pressure at the air discharge port;

a first direction switching assembly comprising a first pipe port, a second pipe port and a third pipe port, wherein the first pipe port is connected to the second air suction port, the second pipe port is connected to the air discharge port, the third pipe port is connected to the liquid accumulator, and the first pipe port is in communication with one of the second pipe port and the third pipe port;

a second direction switching assembly having a first valve port, a second valve port, a third valve port and a fourth valve port, wherein the first valve port is in communication with one of the second valve port and the third valve port, the fourth valve port is in communication with the other one of the second valve port and the third valve port, and the first valve port and the fourth valve port are connected to the air discharge port and the air return port, respectively;

a first heat exchanger having a first end connected with the second valve port and a second end;

a second heat exchanger having a first end connected with the third valve port and a second end; and a flash evaporator having an air outlet, a first port and a second port, wherein the air outlet is connected to the air supplement port, the first port is connected with the second end of the first heat exchanger, the second port is connected with the second end of the second heat exchanger, a first throttling element is connected in series between the first port and the first heat exchanger, and a second throttling element is connected in series between the second port and the second heat exchanger, wherein the method for controlling the air conditioning system comprises:

detecting an operation mode of the air conditioning system, an indoor temperature T1, an outdoor temperature T4 and a user-set temperature TS;

detecting whether the outdoor temperature T4 is larger than a first set temperature T2, when the air conditioning system operates in a refrigerating mode, controlling the first direction switching assembly to communicate the first pipe port with the third pipe port, if the outdoor temperature T4 is larger than the first set temperature T2; controlling the first direction switching assembly to communicate the first pipe port with the third pipe port, if the outdoor temperature T4 is less than or equal to the first set temperature T2 and it is detected that a first difference value T1−TS between the indoor temperature T1 and the user-set temperature TS is larger than or equal to a second set temperature T3; and controlling the first direction switching assembly to communicate the first pipe port with the second pipe port, if the outdoor temperature T4 is less than or equal to the first set temperature T2 and it is detected that the first difference value T1−TS is less than the second set temperature T3; and detecting whether the outdoor temperature T4 is larger than a third set temperature T5, when the air conditioning system operates in a heating mode, controlling the first direction switching assembly to communicate the first pipe port with the third pipe port, if the outdoor temperature T4 is less than or equal to the third set temperature T5; controlling the first direction switching assembly to communicate the first pipe port with the third pipe port, if the outdoor temperature T4 is larger than the third set temperature T5 and it is detected that a second difference value TS−T1 between the user-set temperature TS and the indoor temperature T1 is larger than or equal to a fourth set temperature T6; and controlling the first direction switching assembly to communicate the first pipe port with the second pipe port, if the outdoor temperature T4 is larger than the third set temperature T5 and it is detected that the second difference value TS−T1 is less than the fourth set temperature T6.

6. The method according to claim 5, wherein a value range of the second set temperature T3 is the same with a value range of the fourth set temperature T6.

7. The method according to claim 6, wherein the value range of the second set temperature T3 is from 3° C. to 5° C., and the value range of the fourth set temperature T6 is from 3° C. to 5° C.

8. The method according to claim 5, wherein a value range of the first set temperature T2 is from 30° C. to 40° C.

9. The method according to claim 5, wherein a value range of the third set temperature T5 is from 10° C. below zero to 5° C. below zero.

10. The method according to claim 5, wherein the second direction switching assembly is a four-way valve.

11. The method according to claim 5, wherein the first direction switching assembly is a three-way valve.

12. The method according to claim 5, wherein each of the first throttling element and the second throttling element is an electronic expansion valve.

* * * * *